US006694648B2

(12) United States Patent
Eriksen

(10) Patent No.: US 6,694,648 B2
(45) Date of Patent: Feb. 24, 2004

(54) METATARSAL ARCH SUPPORT

(76) Inventor: Julie Eriksen, 906-C Village Cir., Newark, DE (US) 19713

( * ) Notice: Subject to any disclaimer, the term of this patent is extended or adjusted under 35 U.S.C. 154(b) by 0 days.

(21) Appl. No.: 10/200,097

(22) Filed: Jul. 19, 2002

(65) Prior Publication Data

US 2004/0010945 A1 Jan. 22, 2004

(51) Int. Cl.[7] ..... A61F 5/14; A43B 7/22

(52) U.S. Cl. ..... 36/145; 36/91; 36/180; 36/71

(58) Field of Search ..... 36/43, 44, 71, 36/91, 88, 140, 145, 174, 180

(56) References Cited

U.S. PATENT DOCUMENTS

| | | | | | |
|---|---|---|---|---|---|
| 1,636,044 | A | * | 7/1927 | Connelly | 36/145 |
| 1,656,556 | A | * | 1/1928 | Brown | 36/182 |
| 1,804,009 | A | * | 5/1931 | Gregarek | 36/173 |
| 2,089,384 | A | * | 8/1937 | Levitt | 36/145 |
| 2,310,824 | A | * | 2/1943 | Wyant | 36/145 |
| 4,124,946 | A | * | 11/1978 | Tomlin | 36/43 |
| 4,170,233 | A | | 10/1979 | Bunsick | 128/586 |
| 4,250,886 | A | * | 2/1981 | Riso et al. | 36/180 |
| 5,509,218 | A | | 4/1996 | Arcan et al. | 36/43 |
| 5,572,805 | A | | 11/1996 | Giese et al. | 36/30 |
| 5,625,965 | A | | 5/1997 | Blissett et al. | 36/43 |
| 5,806,209 | A | | 9/1998 | Crowley et al. | 36/28 |
| 5,921,004 | A | | 7/1999 | Lyden | 36/25 |
| 6,021,588 | A | | 2/2000 | Alviso | 36/102 |
| 6,092,310 | A | | 7/2000 | Schoesler | 36/43 |
| 6,105,283 | A | | 8/2000 | Park | 36/159 |
| 6,178,663 | B1 | | 1/2001 | Schoesler | 36/43 |
| 6,205,685 | B1 | | 3/2001 | Kellerman | 36/44 |
| 6,301,805 | B1 | | 10/2001 | Howlett et al. | 36/43 |
| 6,301,807 | B1 | | 10/2001 | Gardiner | 36/155 |
| 6,321,468 | B1 | | 11/2001 | DeGrand et al. | 36/102 |
| 6,345,455 | B1 | | 2/2002 | Greer, Jr. et al. | 36/155 |
| 6,354,020 | B1 | | 3/2002 | Kimball et al. | 36/29 |

OTHER PUBLICATIONS

"Hapad—A Size & Fit For Everyone . . . "; www.supports4u.com/hapad.htm.

"SILOPAD™–Ball–of–Foot Gel Cushion"; www.supports4u.com/silipos/metatarsal.htm.

"Technical Group on Footwear Biomechanics"; www.u-ni–essen.de/~qpd800/FWISB/s7.html.

* cited by examiner

*Primary Examiner*—M. D. Patterson
(74) *Attorney, Agent, or Firm*—RatnerPrestia

(57) ABSTRACT

A metatarsal arch support is described, in which the support has a raised section of such a size and shape as to roughly match and fill the open space that exists between the insole of the shoe and the portion of the foot that spans the second, third, and fourth metatarsals, which normally constitutes an arch when the foot is supporting body weight. Shoes typically exert pressure, causing the metatarsal arch to flatten. Use of the arch support prevents this undesirable effect.

27 Claims, 4 Drawing Sheets

METATARSAL ARCH SUPPORT

FIELD OF THE INVENTION

This invention relates to a device, and a method of using such a device, to provide support to the metatarsal arch of a human foot.

BACKGROUND OF THE INVENTION

For the purposes of stabilizing the foot, the metatarsal heads constitute an arceate form referred to as the metatarsal arch. The metatarsal arch is present whenever the foot is supporting body weight, such as during standing, walking or running, because it allows the foot to function maximally as a supporting, stabilizing and balancing appendage. The toes flex as a result of the formation of the metatarsal arch, so that the distal phalanges contact squarely the underlying surface to permit balancing. In addition, the formation of the metatarsal arch permits the lateral edge of the foot's sole to squarely contact the underlying surface, for the purpose of supporting body weight. Finally, various muscles and tendons characteristically interact to stabilize the foot, support body weight and permit balancing against underlying surfaces.

The term "toe-off" or "push-off" is used to denote the sequence of progressive movements normally experienced in a walking or running gait in preparation for movement from the neutral position, with a neutral position being defined as the subtalar joint being neither pronated nor supinated, to a propulsive phase of the gait cycle. Shoes may apply pressure to the dorsal (upper) surface of the foot because they are not correctly shaped to match the natural contours of the foot, and so prevent entirely the formation of the metatarsal arch. It is sometimes possible to shape a shoe to match the natural contours of the foot so as to not apply pressure to the foot when standing. However, if the shoe is not loose enough or soft enough to apply no pressure to the foot regardless of what position the foot is in, walking or running results in creasing across the top of the shoe when the foot pushes off, applying pressure to the foot and causing the metatarsal arch to flatten.

Metatarsal arch supports are intended to counter these interactions by providing a force opposed to flattening of the arch. However, although the idea of a metatarsal arch support is not new, existing designs are problematic because they provide support under areas of the foot designed to flatten out during normal foot movement and/or under areas of the foot not designed for direct weight bearing, or are incorrectly shaped to match the natural contours of the foot. As a result such designs create additional problems while attempting to solve the original one. Thus there continues to be a need for methods and devices to support the metatarsal arch without adventitiously creating other problems.

SUMMARY OF THE INVENTION

In one aspect, the invention is a metatarsal arch support for a foot in a shoe, the shoe comprising an insole, the foot comprising:

(a) a front part and a plurality of toes, the toes comprising first, second, third, fourth, and fifth proximal phalanges, (b) first, second, third, fourth and fifth metatarsals joined to the first, second, third, fourth, and fifth proximal phalanges at first, second, third, fourth, and fifth metatarsal heads, respectively, (c) a fleshy pad on a plantar surface of the foot comprising a front boundary underlying the first, second, third, fourth and fifth proximal phalanges and a back boundary underlying the first, second, third, fourth, and fifth metatarsals, comprising a recessed apex approximately between the first and second metatarsal heads, (d) a first inflection boundary on the fleshy pad underlying the second, third, and fourth metatarsals, (e) a second inflection boundary on the fleshy pad underlying the second, third and fourth proximal phalanges, approximately coinciding with the front boundary, (f) a third inflection boundary on the fleshy pad between the first and second metatarsals, and (g) a fourth inflection boundary on the fleshy pad between the fourth and fifth metatarsals, the arch support comprising a base and an upper surface contoured to comfortably lie adjacent an area of the fleshy pad bounded by the first, second, third, and fourth inflection boundaries, the upper surface comprising a highest point, the base being at a shoe insole level, wherein the arch support rises from the base to the highest point, wherein the highest point underlies the recessed apex.

In another aspect, the invention is a method for supporting a foot in a shoe, the shoe comprising an insole, the foot comprising (a) a front part and a plurality of toes, the toes comprising first, second, third, fourth, and fifth proximal phalanges, (b) first, second, third, fourth and fifth metatarsals joined to the first, second, third, fourth, and fifth proximal phalanges at first, second, third, fourth, and fifth metatarsal heads, respectively, (c) a fleshy pad on a plantar surface of the foot comprising a front boundary underlying the first, second, third, fourth and fifth proximal phalanges and a back boundary underlying the first, second, third, fourth, and fifth metatarsals, comprising a recessed apex approximately between the first and second metatarsal heads, (d) a first inflection boundary on the fleshy pad underlying the second, third, and fourth metatarsals, (e) a second inflection boundary on the fleshy pad underlying the second, third and fourth proximal phalanges, approximately coinciding with the front boundary, (f) a third inflection boundary on the fleshy pad between the first and second metatarsals, and (g) a fourth inflection boundary on the fleshy pad between the fourth and fifth metatarsals, the method comprising providing in the shoe a metatarsal arch support for the foot, the arch support comprising a base and an upper surface contoured to comfortably lie adjacent an area of the fleshy pad bounded by the first, second, third, and fourth inflection boundaries, the upper surface comprising a highest point, the base being at a shoe insole level, wherein the arch support rises from the base to the highest point, wherein the highest point underlies the recessed apex.

In yet another aspect, the invention is a metatarsal arch supporting shoe insole for supporting a foot in a shoe, the foot comprising:

(a) a front part and a plurality of toes, the toes comprising first, second, third, fourth, and fifth proximal phalanges, (b) first, second, third, fourth and fifth metatarsals joined to the first, second, third, fourth, and fifth proximal phalanges at first, second, third, fourth, and fifth metatarsal heads, respectively, (c) a fleshy pad on a plantar surface of the foot comprising a front boundary underlying the first, second, third, fourth and fifth proximal phalanges and a back boundary underlying the first, second, third, fourth, and fifth metatarsals, comprising a recessed apex approximately between the first and second metatarsal heads, (d) a first inflection boundary on the fleshy pad underlying the second, third, and fourth metatarsals, (e) a second inflection boundary on the fleshy pad underlying the second, third and fourth proximal phalanges, approximately coinciding with the front boundary, (f) a third inflection boundary on the fleshy pad between the first and second metatarsals, and (g) a fourth inflection boundary on the fleshy pad between the fourth and fifth metatarsals, the insole comprising a substantially flat section and a raised section, the raised section comprising a base and an upper surface contoured to comfortably lie adjacent an area of the fleshy pad bounded by the first, second, third, and fourth inflection boundaries, the upper surface comprising a highest point, the base being at a level contiguous with the flat section, wherein the arch support rises from the base to the highest point, wherein the highest point underlies the recessed apex.

In a further aspect, the invention is a shoe comprising an integral metatarsal arch supporting shoe insole for supporting a foot, the foot comprising:

(a) a front part and a plurality of toes, the toes comprising first, second, third, fourth, and fifth proximal phalanges, (b) first, second, third, fourth and fifth metatarsals joined to the first, second, third, fourth, and fifth proximal phalanges at first, second, third, fourth, and fifth metatarsal heads, respectively, (c) a fleshy pad on a plantar surface of the foot comprising a front boundary underlying the first, second, third, fourth and fifth proximal phalanges and a back boundary underlying the first, second, third, fourth, and fifth metatarsals, comprising a recessed apex approximately between the first and second metatarsal heads, (d) a first inflection boundary on the fleshy pad underlying the second, third, and fourth metatarsals, (e) a second inflection boundary on the fleshy pad underlying the second, third and fourth proximal phalanges, approximately coinciding with the front boundary, (f) a third inflection boundary on the fleshy pad between the first and second metatarsals, and (g) a fourth inflection boundary on the fleshy pad between the fourth and fifth metatarsals, the insole comprising a substantially flat section and a raised section, the raised section comprising a base and an upper surface contoured to comfortably lie adjacent an area of the fleshy pad bounded by the first, second, third, and fourth inflection boundaries, the upper surface comprising a highest point, the base being at a level contiguous with the flat section, wherein the arch support rises from the base to the highest point, wherein the highest point underlies the recessed apex, wherein the insole is permanently affixed to the shoe.

It has been found that good metatarsal arch support can be provided by the methods and devices of this invention.

DETAILED DESCRIPTION OF THE INVENTION

Metatarsal Arch Support

The invention will next be described with reference to the Figures in which same numerals are used to identify same elements in all Figures. The Figures are used as illustrations of the invention and are not intended to be limiting, nor are they in scale.

Figure 1:
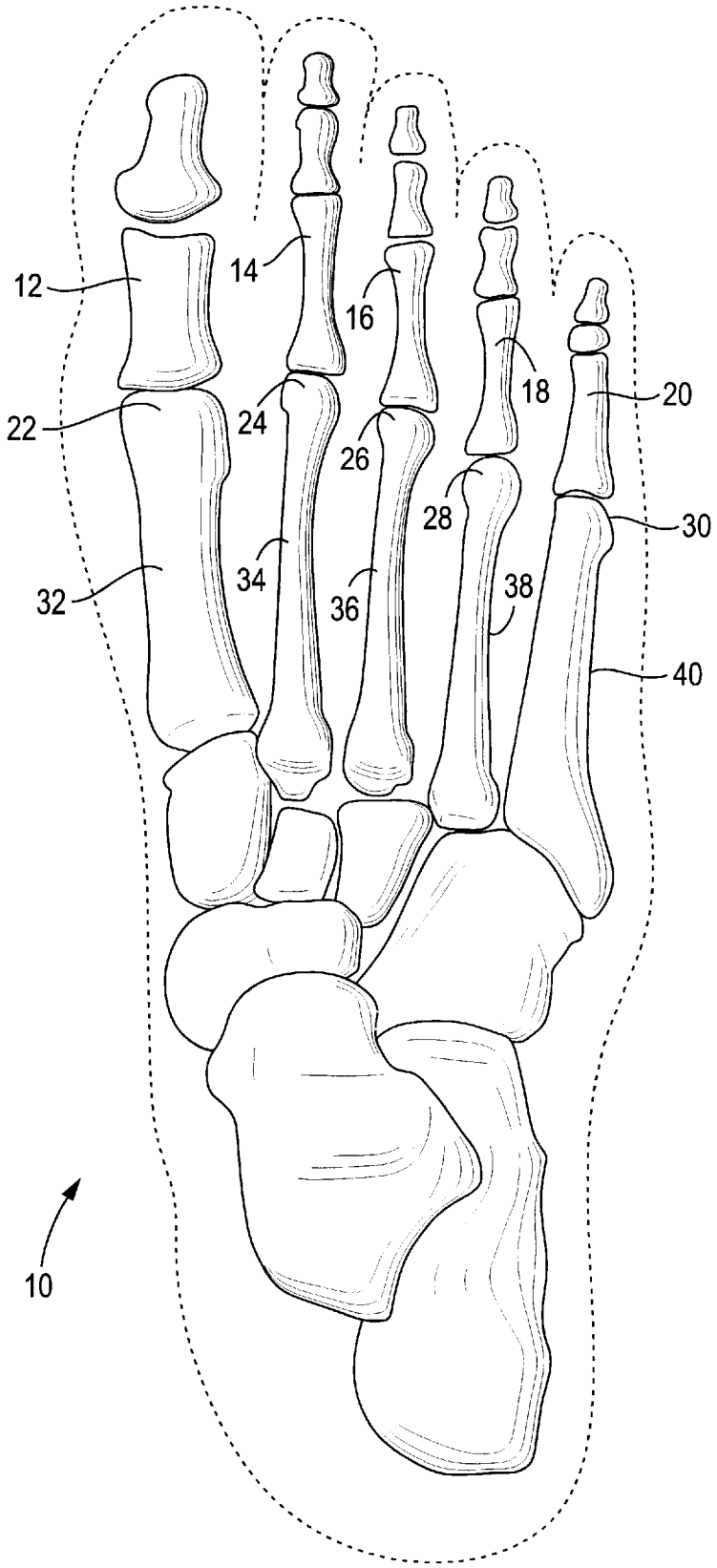
FIG. 1 is a schematic illustration of the bones of a human right foot, viewed from the dorsal (top) side, showing the first through fifth proximal phalanges, the first through fifth metatarsal heads, and the first through fifth metatarsals.

Referring next to FIG. 1 there is shown in schematic representation a dorsal (top) view of human foot 10. Briefly such foot comprises first proximal phalange 12, second proximal phalange 14, third proximal phalange 16, fourth proximal phalange 18, and fifth proximal phalange 20; first metatarsal 32, second metatarsal 34, third metatarsal 36, fourth metatarsal 38, and fifth metatarsal 40; where the ends of the metatarsals where they attach to the respective phalanges are referred to as the first metatarsal head 22, the second metatarsal head 24, the third metatarsal head 26, the fourth metatarsal head 28, and the fifth metatarsal head 30.

Figure 2:
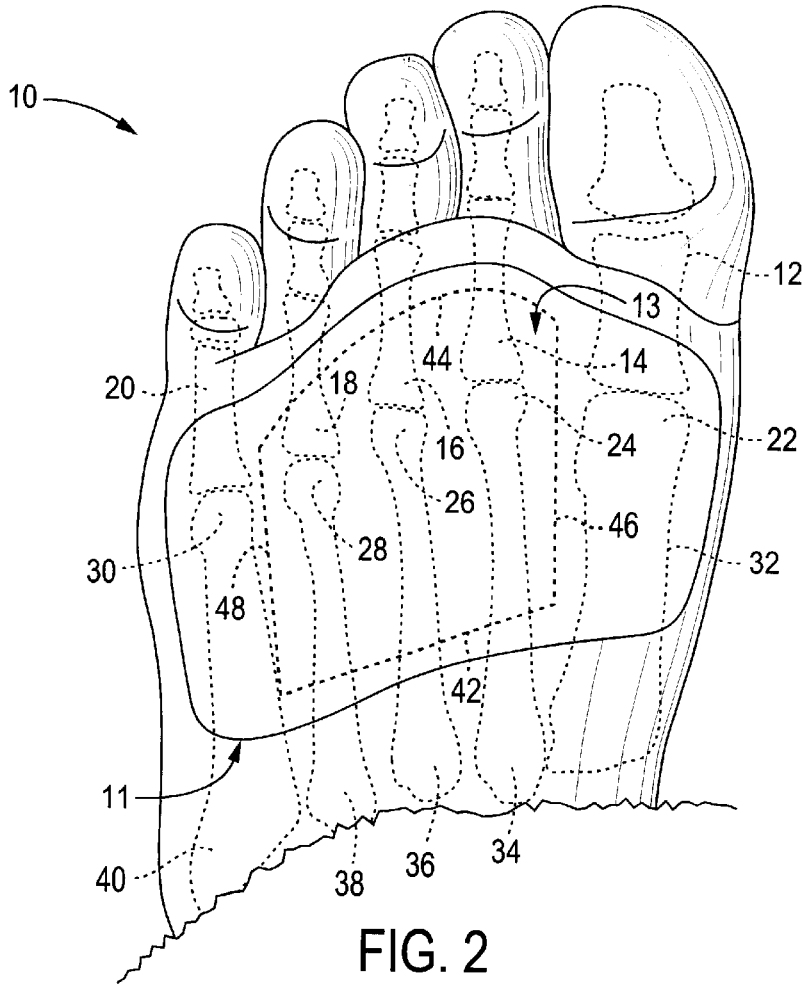
FIG. 2 shows the plantar (bottom) surface of the front part of a right human foot, showing a fleshy pad comprising a recessed apex, and indicating the locations of four inflection boundaries.

FIG. 2 shows a schematic representation of the bottom of the front part of a human right foot, identifying certain parts of the foot that are used for the proper location of the arch support relative to the foot, according to the present invention. A portion of the foot identified as a fleshy pad 11 is shown, extending in the front part partially over the first through fifth proximal phalanges 12, 14, 16, 18, and 20, and rearward over a portion of first through fifth metatarsal 32, 34, 36, 38, and 40. Fleshy pad 11 comprises a recessed apex 13 located roughly between the first and second metatarsal heads 22 and 24. A first inflection boundary 42 lies across second, third, and fourth metatarsals 34, 36, and 38 at approximately the point where fleshy pad 11 ends at its rearward edge. By "inflection boundary" is meant a straight or curved line along the plantar surface of the foot where a crease is formed or a change in direction occurs in the curvature of the surface. A second inflection boundary 44 lies across second, third, and fourth proximal phalanges 14, 16, and 18 at approximately the point where fleshy pad 11 ends at its forward edge. A third inflection boundary 46 lies along and between first and second metatarsals 32 and 34, beginning approximately at first and second metatarsal heads 22 and 24 and extending part way down the length of 32 and 34. A fourth inflection boundary 48 lies along and between fourth and fifth metatarsals 38 and 40, beginning approximately at fourth and fifth metatarsal heads 28 and 30 and extending part way down the length of 38 and 40.

Figure 3A:
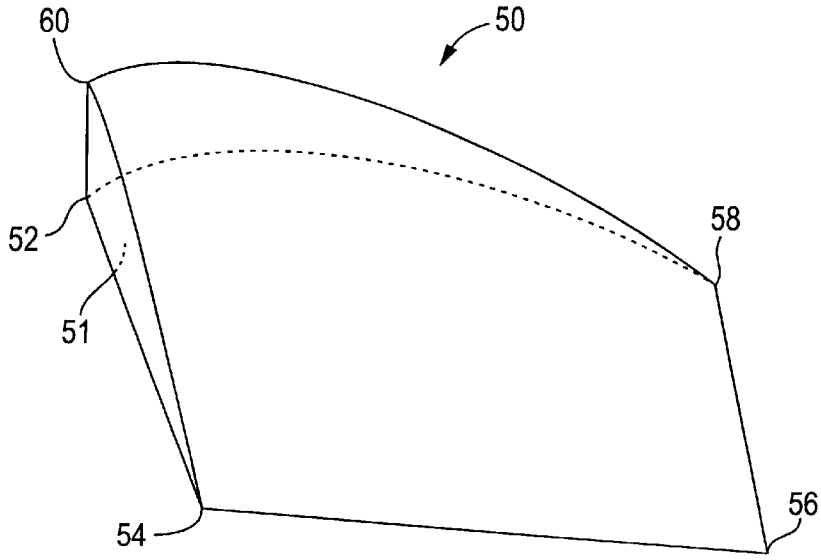
FIG. 3A illustrates an arch support for a right foot, in accordance with the present invention.

FIG. 3A shows in schematic representation an arch support according to this invention. The support has a generally pyramidal structure with a highest point 60. The support tapers gradually from the highest point in three directions towards points 54, 56, and 58 on a support base 51 and tapers toward the base sharply in a fourth direction towards point 52 on base 51. In one embodiment the support taper towards point 52 is substantially vertical.

Figure 3B:
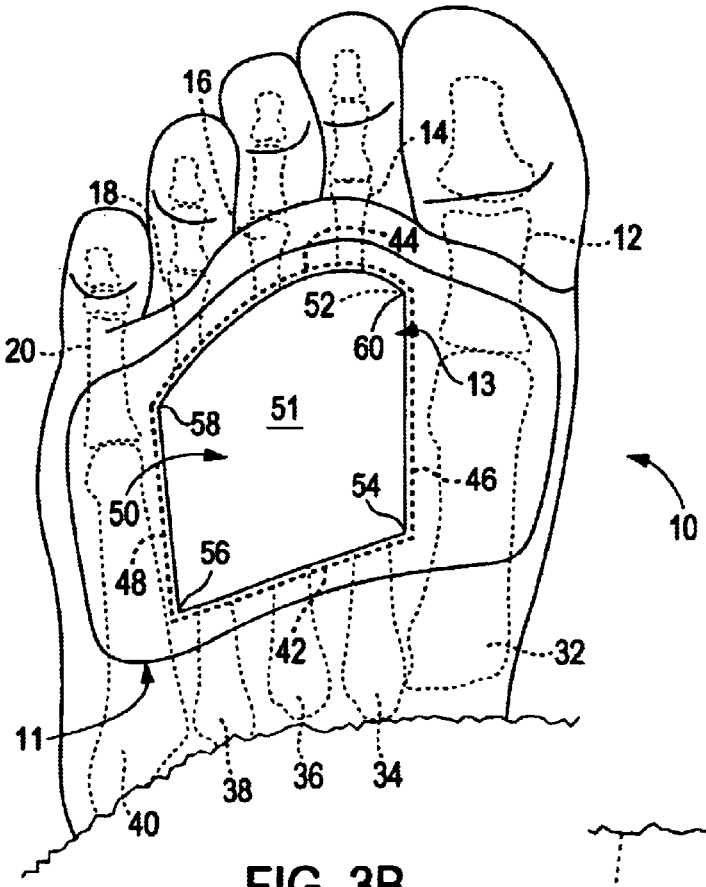
FIG. 3B shows the plantar (bottom) surface of a right foot with the arch support in place, showing the base of the support.

FIG. 3B shows the positioning of the support relative to the foot. The pyramidal design of the support and the location of the support relative to the foot are both significant elements of this invention. As is shown, the highest point 60 (i.e. the apex of the pyramid) is located at approximately the position of recessed apex 13 in fleshy pad 11. The base 51 extends longitudinally and laterally along the insole under the foot in an area roughly bounded by the first through fourth inflection boundaries 42, 44, 46, and 48. The result of this positioning is that support is provided under second, third, and fourth metatarsals and proximal phalanges, labeled 34, 36, 38 and 14, 16, 18, respectively. However, contact with the insole of fleshy pad 11 under the first and fifth metatarsals 32 and 40, the first and fifth metatarsal heads 22 and 30, and the first and fifth proximal phalanges 12 and 20, is not impeded.

Figure 4:
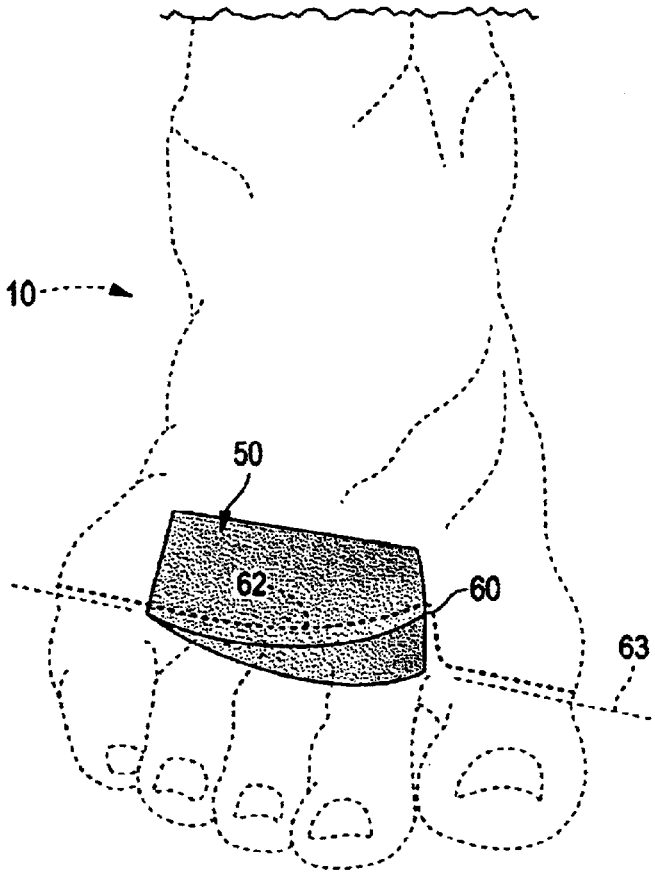
FIG. 4 is a front view of a right foot showing a metatarsal arch in relation to the arch support, whose highest point is indicated.

FIG. 4 shows in schematic representation the relative position of the support under a right foot 10 viewed from the front. The support shape generally conforms to the natural curvature of the metatarsal arch 62, defined by the location of the first through fifth metatarsal heads. Support 50 rises gently from the area near the small toe to a highest point 60 between the first and second metatarsals, and then cuts back sharply to insole level 63, such that the large toe is not supported.

The arch support according to this invention has been described as having a generally pyramidal shape and has been illustrated as having three distinct faces and a base. The number of distinct faces is not critical even though the preferred number is three. The base is approximately quadrilateral, with the face and boundary of the support along the inflection boundary 44 typically being curved to imitate the typical curvature of boundary 44. Boundaries and faces of the support corresponding to boundaries 42, 44, and 48 similarly imitate the typically straight geometry of these boundaries, and so are typically straight. The face of the support along which the fleshy pad rests typically is contoured in a manner complementary to the curvature of the fleshy pad, and the highest point 60 is preferably curved, so that the support will not press uncomfortably against the underside of the foot. As well, since the shapes of individual feet vary considerably, the exact dimensions of the arch support will also vary.

Figure 5A:
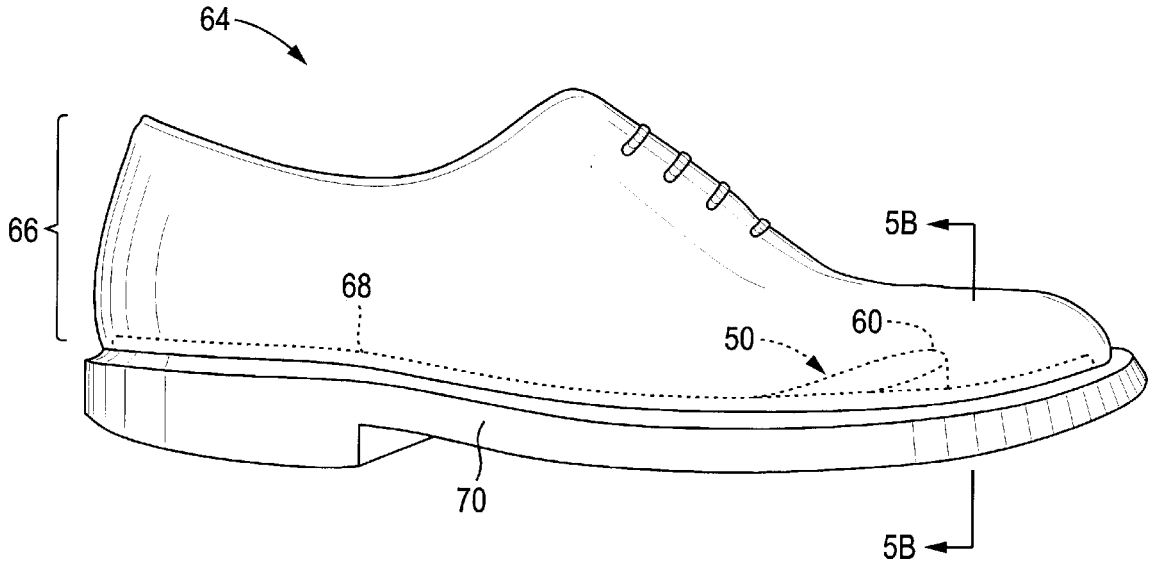
FIG. 5A is a right side view of a right foot shoe, illustrating one embodiment of the invention.
Figure 5B:
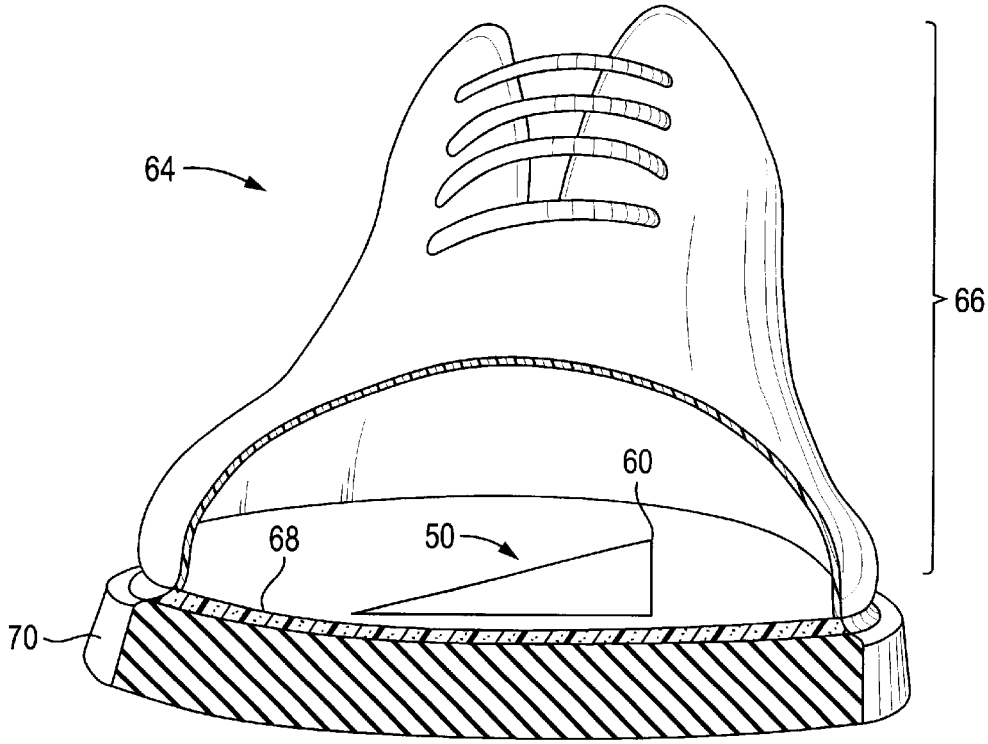
FIG. 5B is a cutaway front view along arrows 5B—5B of the shoe illustrated in FIG. 5A, showing the arch support within the shoe.

FIGS. 5A and 5B show the support according to this invention positioned within a shoe. As shown in FIG. 5A, a shoe 64 having an upper portion 66, and insole 68, and an outsole 70 is fitted with a support 50 having a highest point 60. The support is located in the toe section of the shoe, where it may float free or be attached to insole 68. FIG. 5B is a cutaway front view of shoe 64, showing the lateral location of support 50 on insole 68, and the location of highest point 60.

The arch support may be attached to or integral with an insole, or may float free above the insole and be allowed to position itself naturally under the metatarsal arch. If the support is attached to or integral with an insole, the insole may be supplied as an insert for placement in a shoe by the user, or may be an integral part of a shoe as supplied. FIGS. 5A and 5B are views of arch support 50 on an insole 68, which may be integral with a shoe or supplied as an insert.

According to this invention, there is provided a foot support for use within a shoe. In use, the support is designed such that when placed in a shoe, it lies on the sole directly under the fleshy pad covering the plantar side of the second, third, and fourth metatarsal heads. When so placed, as a person walks or when using shoes with high heels that force the foot in an inclined position, the support maintains the arch in its natural shape working against the shoe material pressure on the dorsal side of the foot.

The support is preferably constructed of a resilient material, by which is meant that the material is compressible but will return to its original shape after the compressing force is removed. However, the material must be firm enough that it will not be compressed excessively when weight is applied to the foot. It will be appreciated that a variety of factors such as body weight may affect how resistant to compression the material should be for optimal effect, and therefore a variety of materials can be used as needed to suit the needs of different individuals.

Useful materials include, inter alia, cross-linked polyethylene, poly(ethylene-vinyl acetate), polyvinyl chloride, synthetic and natural latex rubbers, neoprene, acrylonitrile-butadiene-styrene or styrene-butadiene-styrene block copolymers, thermoplastic elastomers, ethylene-propylene rubbers, silicone elastomers, polystyrene, polyurea, or polyurethane. A preferred material is a polyurethane foam comprising the reaction product of a polyol comprising a flexible chain with any of a monomeric isocyanate, a prepolymerized diisocyanate based on 4,4'-diphenylmethane diisocyanate, a prepolymerized diisocyanate based on toluene diisocyanate, or a mixture of any of these. The foregoing are examples of useful materials of construction for the support, but others will be well known to those skilled in the art.

Such foams can be blown with a chlorofluorocarbon, water, methylene chloride or other gas-producing agents, as well as by mechanically frothing to prepare the shock absorbing resilient layer. Such foams advantageously can be molded into the desired shape or geometry. Non-foam elastomers such as the class of materials known as viscoelastic polymers, or silicone gels, which show high levels of damping when tested by dynamic mechanical analysis performed in the range of −50° C. to 100° C. may also be advantageously employed.

Alternatively, the support can be a laminate construction, that is, a multilayered composite of any of the above materials. Multilayered composites are made from one or more of the above materials such as a combination of polyethylene vinyl acetate and polyethylene (two layers), a combination of polyurethane and polyvinyl chloride (two layers) or a combination of ethylene propylene rubber, polyurethane foam and ethylene vinyl acetate (3 layers). Preferably, the support is made from a molded urethane material.

In another embodiment of the invention, for example when the support is to be used in conjunction with wooden clogs, the support may be made of a hard, non-resilient material, including but not limited to wood or a hard polymeric material. When a hard material is used to make the support, special attention may be required regarding the specific contouring and dimensions of the support, to accommodate its lack of resiliency. In particular, the highest point 60 may advantageously be not quite high enough to directly contact the bottom of the foot when no load is on the foot, so that the support does not need to be compressed to accommodate foot movements.

The invention is especially useful for supporting the metatarsal arch of a human foot in a shoe. It reduces or eliminates compression of the metatarsal arch due to pressure resulting from the flexing and creasing of the top of the shoe, and thereby helps to maintain the stabilizing function of the arch. The support can be employed in either a free-floating manner, or permanently affixed to an insole, which itself may optionally be permanently affixed to a shoe.

Having described the invention, we now claim the following and their equivalents.

What is claimed is:

1. A metatarsal arch support for a foot in a shoe, said shoe comprising an insole, the foot comprising:

(a) a front part and a plurality of toes, the toes comprising first, second, third, fourth, and fifth proximal phalanges, (b) first, second, third, fourth and fifth metatarsals joined to said first, second, third, fourth, and fifth proximal phalanges at first, second, third, fourth, and fifth metatarsal heads, respectively, (c) a fleshy pad on a plantar surface of said foot comprising a front boundary underlying said first, second, third, fourth and fifth proximal phalanges and a back boundary underlying said first, second,.third, fourth, and fifth metatarsals, comprising a recessed apex approximately between said first and second metatarsal heads, (d) a first inflection boundary on said fleshy pad underlying said second, third, and fourth metatarsals, (e) a second inflection boundary on said fleshy pad underlying said second, third and fourth proximal phalanges, approximately coinciding with said front boundary, (f) a third inflection boundary on said fleshy pad between said first and second metatarsals, and (g) a fourth inflection boundary on said fleshy pad between said fourth and fifth metatarsals, the arch support comprising a base and an upper surface contoured to comfortably lie adjacent an area of said fleshy pad bounded by said first, second, third, and fourth inflection boundaries, said upper surface comprising a highest point, said base being at a shoe insole level, wherein said arch support rises from said base to said highest point, wherein said highest point underlies said recessed apex.

2. The support of claim 1 having a generally pyramidal shape comprising an approximately quadrilateral base.

3. The arch support of claim 1 wherein said base is bounded by said first, second, third, and fourth inflection boundaries.

4. The arch support of claim 1 wherein the support comprises a resilient material.

5. The arch support of claim 1 wherein the support comprises a polyurethane foam comprising the reaction product of a polyol comprising a flexible chain with any of a monomeric isocyanate, a prepolymerized diisocyanate based on 4,4'-diphenylmethane diisocyanate, a prepolymerized diisocyanate based on toluene diisocyanate, or a mixture of any of these.

6. A method for supporting a foot in a shoe, said shoe comprising an insole, the foot comprising (a) a front part and a plurality of toes, the toes comprising first, second, third, fourth, and fifth proximal phalanges, (b) first, second, third, fourth and fifth metatarsals joined to said first, second, third, fourth, and fifth proximal phalanges at first, second, third, fourth, and fifth metatarsal heads, respectively, (c) a fleshy pad on a plantar surface of said foot comprising a front boundary underlying said first, second, third, fourth and fifth proximal phalanges and a back boundary underlying said first, second, third, fourth, and fifth metatarsals, comprising a recessed apex approximately between said first and second metatarsal heads, (d) a first inflection boundary on said fleshy pad underlying said second, third, and fourth metatarsals, (e) a second inflection boundary on said fleshy pad underlying said second, third and fourth proximal phalanges, approximately coinciding with said front boundary, (f) a third inflection boundary on said fleshy pad between said first and second metatarsals, and (g) a fourth inflection boundary on said fleshy pad between said fourth and fifth metatarsals, the method comprising providing in said shoe a metatarsal arch support for said foot, said arch support comprising a base and an upper surface contoured to comfortably lie adjacent an area of said fleshy pad bounded by said first, second, third, and fourth inflection boundaries, said upper surface comprising a highest point, said base being at a shoe insole level, wherein said arch support rises from said base to said highest point, wherein said highest point underlies said recessed apex.

7. The method of claim 6 wherein said arch support has a generally pyramidal shape comprising an approximately quadrilateral base.

8. The method of claim 6 wherein said base is bounded by said first, second, third, and fourth inflection boundaries.

9. The method of claim 6 wherein the support comprises a resilient material.

10. The method of claim 6 wherein the support comprises a polyurethane foam comprising the reaction product of a polyol comprising a flexible chain with any of a monomeric isocyanate, a prepolymerized diisocyanate based on 4,4'-diphenylmethane diisocyanate, a prepolymerized diisocyanate based on toluene diisocyanate, or a mixture of any of these.

11. The method of claim 6 further comprising permanently affixing said arch support to said insole.

12. The method of claim 9 further comprising permanently affixing said insole to said shoe.

13. A metatarsal arch supporting shoe insole for supporting a foot in a shoe, the foot comprising:

(a) a front part and a plurality of toes, the toes comprising first, second, third, fourth, and fifth proximal phalanges, (b) first, second, third, fourth and fifth metatarsals joined to said first, second, third, fourth, and fifth proximal phalanges at first, second, third, fourth, and fifth metatarsal heads, respectively, (c) a fleshy pad on a plantar surface of said foot comprising a front boundary underlying said first, second, third, fourth and fifth proximal phalanges and a back boundary underlying said first, second, third, fourth, and fifth metatarsals, comprising a recessed apex approximately between said first and second metatarsal heads, (d) a first inflection boundary on said fleshy pad underlying said second, third, and fourth metatarsals, (e) a second inflection boundary on said fleshy pad underlying said second, third and fourth proximal phalanges, approximately coinciding with said front boundary, (f) a third inflection boundary on said fleshy pad between said first and second metatarsals, and (g) a fourth inflection boundary on said fleshy pad between said fourth and fifth metatarsals, the insole comprising a substantially flat section and a raised section, the raised section comprising a base and an upper surface contoured to comfortably lie adjacent an area of said fleshy pad bounded by said first, second, third, and fourth inflection boundaries, said upper surface comprising a highest point, said base being at a level contiguous with said flat section, wherein said arch support rises from said base to said highest point, wherein said highest point underlies said recessed apex.

14. The insole of claim 13 wherein said arch support has a generally pyramidal shape comprising an approximately quadrilateral base.

15. The insole of claim 13 wherein said base is bounded by said first, second, third, and fourth inflection boundaries.

16. The insole of claim 13 wherein the support comprises a resilient material.

17. The insole of claim 13 wherein the support comprises a polyurethane foam comprising the reaction product of a polyol comprising a flexible chain with any of a monomeric isocyanate, a prepolymerized diisocyanate based on 4,4-diphenylmethane diisocyanate, a prepolymerized diisocyanate based on toluene diisocyanate, or a mixture of any of these.

18. A shoe comprising an integral metatarsal arch supporting shoe insole for supporting a foot, the foot comprising:

(a) a front part and a plurality of toes, the toes comprising first, second, third, fourth, and fifth proximal phalanges, (b) first, second, third, fourth and fifth metatarsals joined to said first, second, third, fourth, and fifth proximal phalanges at first, second, third, fourth, and fifth metatarsal heads, respectively, (c) a fleshy pad on a plantar surface of said foot comprising a front boundary underlying said first, second, third, fourth and fifth proximal phalanges and a back boundary underlying said first, second, third, fourth, and fifth metatarsals, comprising a recessed apex approximately between said first and second metatarsal heads, (d) a first inflection boundary on said fleshy pad underlying said second, third, and fourth metatarsals, (e) a second inflection boundary on said fleshy pad underlying said second, third and fourth proximal phalanges, approximately coinciding with said front boundary, (f) a third inflection boundary on said fleshy pad between said first and second metatarsals, and (g) a fourth inflection boundary on said fleshy pad between said fourth and fifth metatarsals, the insole comprising a substantially flat section and a raised section, the raised section comprising a base and an upper surface contoured to comfortably lie adjacent an area of said fleshy pad bounded by said first, second, third, and fourth inflection boundaries, said upper surface comprising a highest point, said base being at a level contiguous with said flat section, wherein said arch support rises from said base to said highest point, wherein said highest point underlies said recessed apex, wherein said insole is permanently affixed to said shoe.

19. The shoe of claim 18 wherein said arch support has a generally pyramidal shape comprising an approximately quadrilateral base.

20. The shoe of claim 18 wherein said base is bounded by said first, second, third, and fourth inflection boundaries.

21. The shoe of claim 18 wherein the support comprises a resilient material.

22. The shoe of claim 18 wherein the support comprises a polyurethane foam comprising the reaction product of a polyol comprising a flexible chain with any of a monomeric isocyanate, a prepolymerized diisocyanate based on 4,4'-diphenylmethane diisocyanate, a prepolymerized diisocyanate based on toluene diisocyanate, or a mixture of any of these.

23. A metatarsal arch support for a foot in a shoe, said shoe comprising an insole, the foot comprising:

(a) a front part and a plurality of toes, the toes comprising first, second, third, fourth, and fifth proximal phalanges, (b) first, second, third, fourth and fifth metatarsals joined to said first, second, third, fourth, and fifth proximal phalanges at first, second, third, fourth, and fifth metatarsal heads, respectively, (c) a fleshy pad on a plantar surface of said foot comprising a front boundary underlying said first, second, third, fourth and fifth proximal phalanges and a back boundary underlying said first, second, third, fourth, and fifth metatarsals, comprising a recessed apex approximately between said first and second metatarsal heads, (d) a first inflection boundary on said fleshy pad underlying said second, third, and fourth metatarsals, (e) a second inflection boundary on said fleshy pad underlying said second, third and fourth proximal phalanges, approximately coinciding with said front boundary, (f) a third inflection boundary on said fleshy pad between said first and second metatarsals, and (g) a fourth inflection boundary on said fleshy pad between said fourth and fifth metatarsals, the arch support comprising a base and an upper surface contoured to comfortably lie adjacent an area of said fleshy pad bounded by said first, second, third, and fourth inflection boundaries, said upper surface comprising a highest point, said base being at a shoe insole level, wherein said arch support rises from said base to said highest point, wherein said highest point underlies said recessed apex, said support having a generally pyramidal shape comprising an approximately quadrilateral base bounded by said first, second, third, and fourth inflection boundaries, wherein said support comprises a polyurethane foam comprising the reaction product of a polyol comprising a flexible chain with any of a monomeric isocyanate, a prepolymerized diisocyanate based on 4,4'-diphenylmethane diisocyanate, a prepolymerized diisocyanate based on toluene diisocyanate, or a mixture of any of these.

24. A method for supporting a foot in a shoe, said shoe comprising an insole, the foot comprising (a) a front part and a plurality of toes, the toes comprising first, second, third, fourth, and fifth proximal phalanges, (b) first, second, third, fourth and fifth metatarsals joined to said first, second, third, fourth, and fifth proximal phalanges at first, second, third, fourth, and fifth metatarsal heads, respectively, (c) a fleshy pad on a plantar surface of said foot comprising a front boundary underlying said first, second, third, fourth and fifth proximal phalanges and a back boundary underlying said first, second, third, fourth, and fifth metatarsals, comprising a recessed apex approximately between said first and second metatarsal heads, (d) a first inflection boundary on said fleshy pad underlying said second, third, and fourth metatarsals, (e) a second inflection boundary on said fleshy pad underlying said second, third and fourth proximal phalanges, approximately coinciding with said front boundary, (f) a third inflection boundary on said fleshy pad between said first and second metatarsals, and (g) a fourth inflection boundary on said fleshy pad between said fourth and fifth metatarsals, the method comprising providing in said shoe a metatarsal arch support for said foot, said arch support comprising a base and an upper surface contoured to comfortably lie adjacent an area of said fleshy pad bounded by said first, second, third, and fourth inflection boundaries, said upper surface comprising a highest point, said base being at a shoe insole level, wherein said arch support rises from said base to said highest point, wherein said highest point underlies said recessed apex, wherein said arch support has a generally pyramidal shape comprising an approximately quadrilateral base bounded by said first, second, third, and fourth inflection boundaries, wherein the support comprises a polyurethane foam comprising the reaction product of a polyol comprising a flexible chain with any of a monomeric isocyanate, a prepolymerized diisocyanate based on 4,4'-diphenylmethane diisocyanate, a prepolymerized diisocyanate based on toluene diisocyanate, or a mixture of any of these, the method further comprising permanently affixing said arch support to said insole.

25. The method of claim 24 further comprising permanently affixing said insole to said shoe.

26. A metatarsal arch supporting shoe insole for supporting a foot in a shoe, the foot comprising:

(a) a front part and a plurality of toes, the toes comprising first, second, third, fourth, and fifth proximal phalanges, (b) first, second, third, fourth and fifth metatarsals joined to said first, second, third, fourth, and fifth proximal phalanges at first, second, third, fourth, and fifth metatarsal heads, respectively, (c) a fleshy pad on a plantar surface of said foot comprising a front boundary underlying said first, second, third, fourth and fifth proximal phalanges and a back boundary underlying said first, second, third, fourth, and fifth metatarsals, comprising a recessed apex approximately between said first and second metatarsal heads, (d) a first inflection boundary on said fleshy pad underlying said second, third, and fourth metatarsals, (e) a second inflection boundary on said fleshy pad underlying said second, third and fourth proximal phalanges, approximately coinciding with said front boundary, (f) a third inflection boundary on said fleshy pad between said first and second metatarsals, and (g) a fourth inflection boundary on said fleshy pad between said fourth and fifth metatarsals, the insole comprising a substantially flat section and a raised section, the raised section comprising a base and an upper surface contoured to comfortably lie adjacent an area of said fleshy pad bounded by said first, second, third, and fourth inflection boundaries, said upper surface comprising a highest point, said base being at a level contiguous with said flat section, wherein said arch support rises from said base to said highest point, wherein said highest point underlies said recessed apex, wherein said arch support has a generally pyramidal shape comprising an approximately quadrilateral base bounded by said first, second, third, and fourth inflection boundaries, wherein the support comprises a polyurethane foam comprising the reaction product of a polyol comprising a flexible chain with any of a monomeric isocyanate, a prepolymerized diisocyanate based on 4,4'-diphenylmethane diisocyanate, a prepolymerized diisocyanate based on toluene diisocyanate, or a mixture of any of these.

27. A shoe comprising an integral metatarsal arch supporting shoe insole for supporting a foot, the foot comprising:

(a) a front part and a plurality of toes, the toes comprising first, second, third, fourth, and fifth proximal phalanges, (b) first, second, third, fourth and fifth metatarsals joined to said first, second, third, fourth, and fifth proximal phalanges at first, second, third, fourth, and fifth metatarsal heads, respectively, (c) a fleshy pad on a plantar surface of said foot comprising a front boundary underlying said first, second, third, fourth and fifth proximal phalanges and a back boundary underlying said first, second, third, fourth, and fifth metatarsals, comprising a recessed apex approximately between said first and second metatarsal heads, (d) a first inflection boundary on said fleshy pad underlying said second, third, and fourth metatarsals, (e) a second inflection boundary on said fleshy pad underlying said second, third and fourth proximal phalanges, approximately coinciding with said front boundary, (f) a third inflection boundary on said fleshy pad between said first and second metatarsals, and (g) a fourth inflection boundary on said fleshy pad between said fourth and fifth metatarsals, the insole comprising a substantially flat section and a raised section, the raised section comprising a base and an upper surface contoured to comfortably lie adjacent an area of said fleshy pad bounded by said first, second, third, and fourth inflection boundaries, said upper surface comprising a highest point, said base being at a level contiguous with said flat section, wherein said arch support rises from said base to said highest point, wherein said highest point underlies said recessed apex, wherein said insole is permanently affixed to said shoe, wherein said arch support has a generally pyramidal shape comprising an approximately quadrilateral base bounded by said first, second, third, and fourth inflection boundaries, wherein the support comprises a polyurethane foam comprising the reaction product of a polyol comprising a flexible chain with any of a monomeric isocyanate, a prepolymerized diisocyanate based on 4,4'-diphenylmethane diisocyanate, a prepolymerized diisocyanate based on toluene diisocyanate, or a mixture of any of these.

* * * * *